United States Patent [19]

Iida

[11] 4,183,409

[45] Jan. 15, 1980

[54] AUTOMATIC FIRE-EXTINGUISHING SYSTEM

[75] Inventor: Makoto Iida, Fuchu, Japan

[73] Assignee: Security Patrols Co., Ltd., Tokyo, Japan

[21] Appl. No.: 850,009

[22] Filed: Nov. 9, 1977

Related U.S. Application Data

[63] Continuation-in-part of Ser. No. 695,035, Jun. 11, 1976, abandoned.

[51] Int. Cl.[2] ..... A62C 35/00

[52] U.S. Cl. ..... 169/11; 169/26; 169/75; 169/52

[58] Field of Search ..... 169/61, 9, 11, 19, 20, 169/26, 52, 23, 75

[56] References Cited

U.S. PATENT DOCUMENTS

| | | | |
|---|---|---|---|
| 3,713,491 | 1/1973 | Grabowski | 169/61 |
| 4,013,128 | 3/1977 | Davis | 169/61 |

*Primary Examiner*—John J. Love

*Attorney, Agent, or Firm*—Armstrong, Nikaido, Marmelstein & Kubovcik

[57] ABSTRACT

Disclosed is an automatic fire-extinguishing system comprising one or more portable automatic fire-extinguishers placed at desired locations within a region wherein automatic extinguishment should be effected when a fire occurs therein. Each of the fire-extinguishers includes integrally a bomb containing a fire-extinguishing gas under a pressure condition and a gas jetting nozzle connected through a valve to the bomb. At least one fire sensor is arranged at a desired location within the region. Each fire extinguisher is provided with an electro-mechanical means for opening the valve, an electrical means for actuating the opening means and an internal gas pressure detecting switch, and; an electric control circuit formed by the combination of the electric circuit of the opening means, electrical actuating means and the gas pressure detecting switch which are connected in series. If a plurality of fire extinguishers are utilized, the electric control circuits of these fire extinguishers are connected in series in such a way that the electrical actuating means of one fire extinguisher is capable of being actuated in response to a fire signal from the fire sensor while the electrical actuating means of the other fire extinguishers are capable of being actuated by an output signal of the internal gas pressure detecting switch of an adjacent upstream fire extinguisher.

7 Claims, 6 Drawing Figures

AUTOMATIC FIRE-EXTINGUISHING SYSTEM

This application is a continuation-in-part of U.S. Patent Application Ser. No. 695,035, filed June 11, 1976 now abandoned.

BACKGROUND OF THE INVENTION

1. Field of the Invention

This invention relates to an automatic fire-extinguishing system, and particularly to an automatic fire-extinguishing system utilizing a fire-extinguishing gas.

2. Description of the Prior Art

In conventional automatic fire-extinguishing systems utilizing a fire-extinguishing gas, a bomb containing a fire-extinguishing gas, such as halon gas, under pressure is provided at a location. Several gas jetting nozzles are arranged at desired locations within a region wherein automatic extinguishing should be effected when a fire occurs therein. The gas jetting nozzles are connected through a valve and a pipe to the bomb. Fire sensors are arranged at desired locations within the region. In response to a fire signal from the fire sensors, the valve is opened to cause fire-extinguishing gas to jet from the gas jetting nozzles into the region so that automatic extinguishing can be effected therein.

However, since such conventional automatic fire-extinguishing systems require a complicated system of gas pipes from a gas bomb to the gas jetting nozzles, the cost and installation of the pipes is expensive. Moreover, since the gas pipes are fixedly arranged in the walls, ceiling, etc., of a room defining a region wherein automatic extinguishing should be effected when fire occurs therein, it is not easy to remove the gas pipes and to change the arrangement of the gas jetting nozzles. Furthermore, the gas bomb to be used must have a capacity comparable with the space of the region wherein automatic extinguishing should be effected and, therefore, gas bombs having different capacities must be prepared for different regions. This is very uneconomical.

To eliminate the drawbacks of the above-mentioned conventional fire-extinguishing system, G. J. Grabowski et al invented the fire protection apparatus which is disclosed in the U.S. Pat. No. 3,713,491. In this patent, a portable automatic fire protection system is disclosed comprising battery powered, independent suppressor units, each including a supply of fire extinguishing fluid and a fire detector. The connection of the individual unit's control circuits provides a control circuit network that automatically initiates an extinguishing fluid discharge from all units in response to fire detection by any single unit.

Even though the Grabowski et al system eliminates the above mentioned problems of the previous pipe arrangement, the sensing capability of this system is lowered because of the restricted disposition of the fire detector upon each independent suppressor. Since each suppressor is provided with the own-battery, if a number of suppressors are utilized for the fire-extinguishing system, the cost of the batteries becomes high.

The main object of this invention is to provide an automatic fire-extinguishing system which eliminates the above described disadvantages of the prior arts, and to enable easy installation or removal of the system in or from a region wherein automatic fire-extinguishing should be effected, and to allow a flexible arrangement of gas jetting nozzles according to the size and shape of the region.

SUMMARY OF THE INVENTION

The system of the present invention comprises one or more portable automatic fire-extinguishers placed at desired locations within a region wherein automatic extinguishing should be effected when a fire occurs therein; each of the fire-extinguishers integrally including a bomb containing a fire-extinguishing gas under pressure and a gas jetting nozzle connected through a valve to said bomb; at least one fire sensor being arranged at a desired location within the region; each fire extinguisher being provided with an electro-mechanical means for opening the valve, an electrical means for actuating the opening means and a gas pressure detecting switch which detects the gas pressure in the bomb; an electrical control circuit being formed by the combination of the electric circuits of the opening means, electrical actuating means and the gas pressure detecting switch which are connected in series. If a plurality of fire extinguishers are utilized, the electric control circuits of these fire extinguishers are connected in series in such a way that the electrical actuating means of one fire extinguisher is capable of being actuated in response to a fire signal from the fire sensor, while the electrical actuating means of the other fire extinguishers are capable of being actuated by an output signal of the internal gas pressure detecting switch of an adjacent upstream fire extinguisher. The electric circuit of the fire sensor (or sensors) is connected to a DC power source which is supplied from an AC power source via a conventional transformer and a rectifier or a DC power source of a battery. The above-mentioned electric control circuit is also connected to the same power supply source as the electric circuit of the fire sensor (or sensors). In this automatic fire-extinguishing system, the electro-mechanical opening means of the fire extinguishers are actuated one by one in accordance with the connection order of a series of the control circuits of the fire extinguishers. Therefore, a power source of very low capacity is required, as compared to an automatic fire-extinguishing system wherein all fire extinguishers are capable of being simultaneously actuated in response to a fire signal issued from any one of fire sensors. Since the control circuit of each fire extinguisher is very simple and a plurality of control circuits are easily connected in series, the cost of the employment of the automatic fire extinguishing system is greatly reduced from the cost of employment of the systems of the prior arts.

DETAILED EXPLANATION OF THE INVENTION

Figure 1:
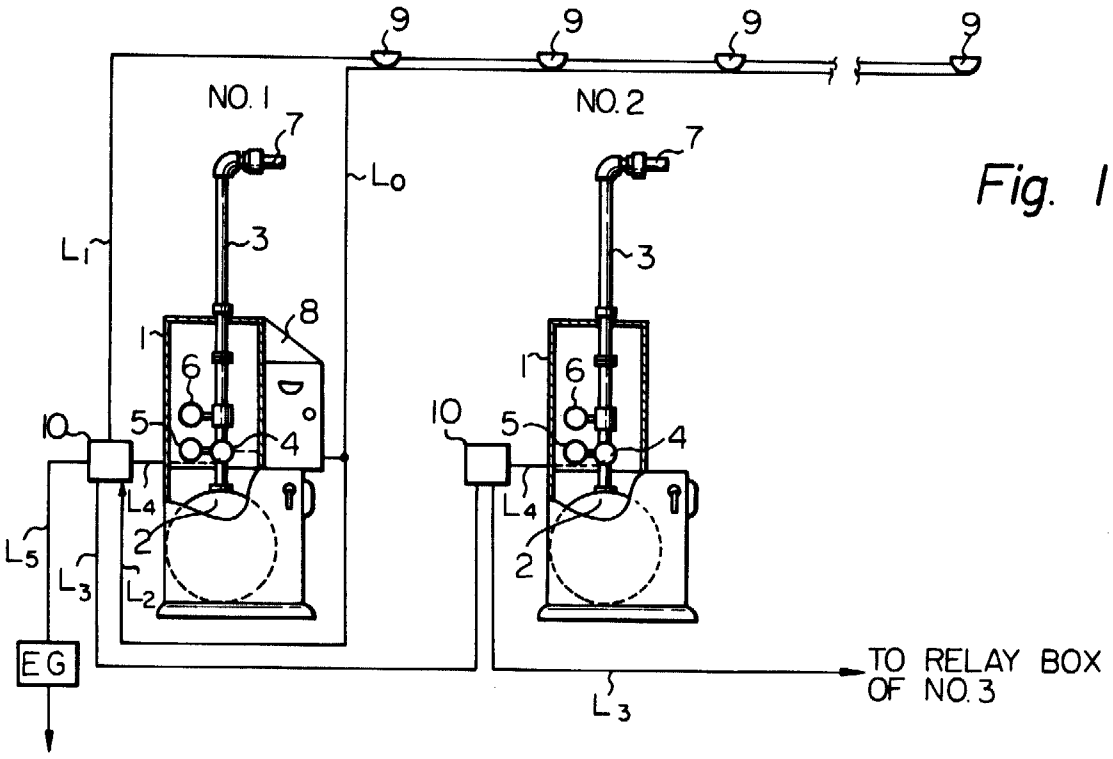
FIG. 1 is a schematic diagram of one embodiment of the automatic fire-extinguishing system according to this invention.

As illustrated in FIG. 1, a plurality of portable automatic fire-extinguishers (No. 1, No. 2, . . . ) are placed at desired locations within a region, for example, a room wherein automatic extinguishing should be effected when a fire occurs therein. The number of fire-extinguishers may be selected according to the size and shape of the region.

In this system, the portable automatic fire-extinguisher No. 1 comprises a housing 1, a bomb 2, containing a fire-extinguishing gas such as halon gas under pressure and accomodated in the housing 1, and a conduit 3 for fire-extinguishing gas extending from the bomb 2 to the outside of the housing. The conduit 3 is provided at its intermediate portions with a valve 4, a internal pressure detecting switch 5 and gas jet detecting switch 6 and at its end opposite the bomb 2 with a gas jetting nozzle 7.

A control box 8 involves an intermediate power source comprising a transformer and a rectifier, and electric elements for indicating the condition of the elements of the automatic fire-extinguishing system according to the present invention. The intermediate power source is connected to a conventional AC power supply source. Instead of utilizing such a power supply system, a battery such as a Cadomium battery may be utilized. To prevent a trouble due to an unexpected electric power failure, it is preferable to use an alternatively actuatable power supply system comprising the above-mentioned intermediate power source and the battery.

The portable automatic fire-extinguishers (No. 2, . . . ) other than the fire-extinguisher No. 1 in this system are identical with the fire-extinguisher No. 1, except that control box 8 is removed. The control box 8 can be exchangeably mounted on any of the fire-extinguishers (No. 2, . . . ).

Fire sensors 9 are arranged at desired locations within the region, for example at several positions in the ceiling of a room defining the region. A fire signal from the fire sensors 9 is transmitted over a line $L_1$ to a relay box 10 of the first fire extinguisher No. 1.

The sensors 9 recieve electric power from the intermediate power source via a line $L_0$. The earth terminal of the relay box 10 of the first fire extinguisher No. 1 is connected to a ground of the intermediate power source. When a signal issued from any of the fire sensors 9 is transmitted to the relay box 10 of the first fire extinguisher No. 1, which contains a unit control circuit, an electro-mechanical means (not shown) for opening the valve 4 is actuated so that fire-extinguishing gas from the bomb 2 is jetted through the conduit 3 and out of the gas jetting nozzle 7. Therefore, the gas pressure of the bomb 2 is rapidly reduced. The gas detecting switch 6 comprises a bellows (not shown) which is capable of expanding along the axial direction thereof if the gas is contained in the bomb 2 in compressed condition, and a limit switch (not shown) which is actuated by the deformation of the bellows. When the gas contained in the bomb 2 of the first fire extinguisher No. 1 is jetted from the nozzle 7, since the gas pressure in the bomb 2 is remarkably lowered, the switch 6 detects this condition and issues a signal to actuates the relay box 10 of the second fire extinguisher No. 2, by way of a connection line $L_3$. Consequently, an electro-mechanical means (not shown) for opening the valve 4 of the second fire extinguisher No. 2 is actuated to open the valve 4. The relay box 10 of the third fire extinguisher No. 3 (not shown) is actuated by a signal issued from the switch 6 of the second fire extinguisher No. 2 in the same manner as the signal transmission from the switch 6 of the first fire extinguisher No. 1 to the relay box 10 of the second fire extinguisher No. 2 as mentioned hereinbefore.

If more than four fire extinguishers are utilized for the automatic fire extinguishing system according to the present invention, the transmission of the actuation signal from the switch 6 of the upstream fire extinguisher to the downstream fire extinguisher is carried out in the same manner as mentioned above. Therefore, it is not necessary to use a power source having large capacity. Consequently, a power source having only a capacity sufficient for actuating the sensors 9 and the control circuit of a single fire extinguisher can be utilized for the automatic fire extinguishing system provided with a plurality of fire extinguishers, according to the present invention.

The control circuit of the automatic fire extinguishing system according to the present invention can be made very easily by simply connecting the control circuits of the component fire extinguishers in series. This is one of the distinguished merits of the present invention.

In the above-mentioned embodiment of the automatic fire extinguishing system shown in FIG. 1, if a control circuit of anyone of the fire extinguishers, for example that of the fire extinguisher No. 1, does not work for any reason, the control circuit of the downstream fire extinguishers can not work, because of the construction of the assembled control circuit. Therefore, in this condition, the fire extinguishing system can not operate functionally. To prevent such a problem from ocurring, a time control system is applied to each fire extinguisher. The detailed construction and function of this system is hereinafter explained with reference to FIG. 3.

According to our experience, there is a possibility of gas leakage from the bomb 2. If the contained gas does leak from the bomb 2, it is impossible to expect the effective jetting of gas from the nozzle 7 and, on the other hand, the switch 6 is actuated in spite of the fact that the fire sensors 9 have not detected a fire. In such condition, the control circuits of the fire extinguishers at the respective positions downstream from the position of the fire extinguisher from which the gas has leaked, are actuated by the signal issued from the switch 6 of the fire extinguisher from which the gas leaked. Therefore, it is preferable to prevent such a problem caused by possible gas leakage from the bomb 2. To completely prevent this problem, the electric circuit of the internal pressure detecting switch 5 is inserted in a line connecting the control circuits of two adjacent fire-extinguishers so that, even if the switch 6 of an upstream fire extinguisher of two adjacent fire extinguishers issues a signal to actuate the elements of the downstream fire extinguisher, the transmission of such signal is interrupted by the electric circuit of the internal pressure detecting switch 5 of the upstream fire extinguisher from which the gas leaked. Consequently, any possible problem due to unexpected gas leakage from any fire extinguisher can be perfectly prevented.

The automatic fire extinguishing system may be designed to transmit a fire signal over a line $L_5$ and a commercial telephone line via an EG station to a remote central monitor.

The automatically fire extinguishing system of this invention, as described above, requires only one kind of automatic fire extinguisher, such as the fire extinguisher No. 1 and No. 2 described above which have a suitable same capacity. Namely in the present system, a necessary number of the same portable fire extinguishers may be placed at suitable locations within a region according to the size and shape of the region. Therefore, the present system is very economical and flexible, compared with conventional systems wherein many kinds of bombs having different capacities must be prepared. Furthermore, the automatic fire extinguishing system of this invention can be installed in a region only by placing one or more portable fire extinguishers such as the fire extinguishers (No. 1, No. 2, . . . ) at suitable locations within the region, but requires no complicated system of pipes from a gas bomb to a number of gas jetting nozzles, which system of pipes would be needed in conventional systems as described hereinbefore. Therefore, installation and removal of the present system can be very easily effected, and modification of the arrangement of the fire extinguishers can be very easily carried out.

Moreover, in the present system, only one exchangeable controller 8 may be prepared for the fire-extinguisher No. 1 and similar controllers for the other fire-extinguishers (No. 2, . . . ) may be omitted. As a result a very economical system can be employed.

Figure 2A:
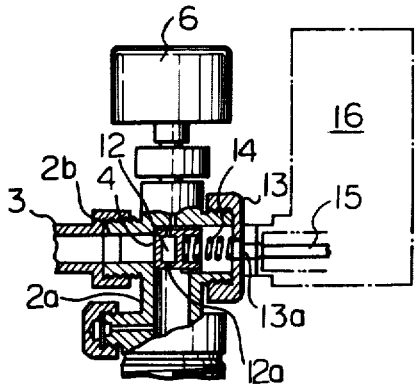
FIG. 2A is a schematic side view of a valve provided with an electro-mechanical means for opening the valve and an internal gas pressure detecting switch applied for each fire-extinguisher according to the present invention.
Figure 2B:
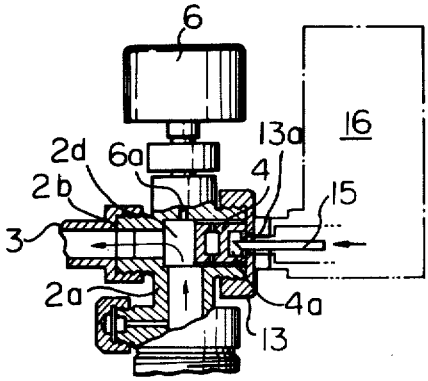
FIG. 2B is a schematic side view of the valve shown in FIG. 2A, indicating the opening condition thereof.

Detailed Explanation of the Valve Disposed in a Connected Portion between the Bomb and the Conduit Extending to the Nozzle Referring to FIGS. 2A and 2B, the construction and function of the valve 4 disposed in a connected portion between the bomb 2 and the conduit 3 extending to the nozzle 7 is explained in detail. A conduit 2*a* extending from the bomb 2 is provided with a T shaped head portion 2*b* wherein both ends are opened. One end of the T shaped head portion 2*b* is threaded and thread engaged with an end of the conduit 3, while the other end of the T shaped head portion 2*b* is also threaded and thread engaged with a cap 13 so as to seal the opening. The cap 13 is provided with a central aperture which is covered by a metallic or plastic film 13*a*. The valve 4 is slidably positioned in a cylindrical room of the T shaped head portion 2*b*. The cylindrical room is composed of a narrow room and a wide room so that a ring shaped wall is formed between these two component rooms as shown in FIGS. 2A and 2B. The valve 4 is positioned in the wide room in such a way that when the valve 4 contacts the ring shaped wall, the connection between the conduit 3 and the conduit 2*a* is interrupted, while when the valve 4 moves away from the above-mentioned ring shaped wall toward the cap 13, the conduit 3 is connected to the conduit 2*a*. The valve 4 is provided with a cylindrical recess 4*a* (FIG. 2B) coaxially formed therein at the side of the cap 13 and a cylindrical room 12 formed therein as shown in FIG. 2A. The room 12 is connected to outside of the body of the valve 4 by means of a plurality of thin conduits 12*a* which are capable of connecting the room 12 to the conduit 2*a* only when the valve 4 interrupts the connection between the conduit 2*a* and the conduit 3. An expansion spring 14 is inserted in a space formed by the cylindrical room 4*a* and a possible space between the valve 4 and the cap 13, and consequently, the valve 4 is always urged toward the conduit 3. The spring force of the helical spring 14 is so selected that if the gas pressure in the space involving the spring 14 is reduced by the gas leaking through any possible hole in the film 13*a*, the pressure imparted to the transversal wall of the cylindrical room 12 exceeds the resistance created by the spring 14, and consequently, the valve 4 is displaced toward the cap 13. An electro-mechanical means for opening the valve 4 is a solenoid mechanism 16 provided with a needle 15 which is capable of inserting into the film 13*a* at a center position thereof when the solenoid is actuated. FIG. 2A represents the standby condition of the needle 15, while FIG. 2B represents the working condition of the needle 15 wherein the film 13*a* is broken at the center position thereof. When the film 13*a* is broken at the center position thereof, the gas contained in the space formed by the cylindrical space 4*a* and the space between the valve 4 and the cap 13 escapes through the brokened aperture of the film 13*a*, and consequently, the gas pressure in this space is instantly lowered. Accordingly, the valve 4 is displaced from its interrupt position toward the cap 13 and the conduit 2*a* is connected to the conduit 3.

When the fire extinguishing gas is supplied into the bomb 2, before assembling the necessary elements of each fire extinguisher, a gas supply conduit (not shown) is firstly thread engaged with the T shaped head portion of the conduit 2*a* while the other end of the T shaped head portion is sealed with the cap 13. Then, the fire extinguishing gas of high pressure is supplied via the gas supply conduit. In this condition, the valve 4 is displaced to the position adjacent to the cap 13 so that the gas supply conduit is connected to the conduit 2*a*. After the bomb 2 is filled with the fire extinguishing gas, the gas supply is stopped. Since there is a very small cylindrical clearance between the peripheral surface of the valve 4 and the inside wall of the T shaped head portion, the space formed by the cylindrical space 4*a* and the space between the valve and the cap 13 is gradually filled with the gas and the gas pressure in the above-mentioned space becomes the same as that of the bomb 2. In this condition, the valve 4 is automatically displaced toward the ring shaped wall formed between the thin cylindrical portion and the thick cylindrical portion of the T shaped head portion 2*b*, and finally, the valve 4 is urged against the above-mentioned ring shaped wall so that the T shaped head portion 2*b* is completely sealed by the valve 4.

The gas jet detecting switch 6 comprises a bellows (not shown) always connected to the conduit 2*a* as shown in FIG. 2A. Therefore when the bomb 2 is filled with the fire extinguishing gas, the bellows is axially expanded in accordance with the gas pressure. A limit switch (not shown) is disposed at a position adjacent to the bellows in such a condition that the limit switch normally closes a circuit when the belows is axially expanded, and the above-mentioned circuit is opened and another circuit is closed when the axial deformation of the bellows is eliminated. The above-mentioned condtion of elimination of the axial deformation of the bellows corresponds to the gas ejection from the bomb 2.

Control Circuit of the Automatic Fire-extinguishing System

Figure 3:
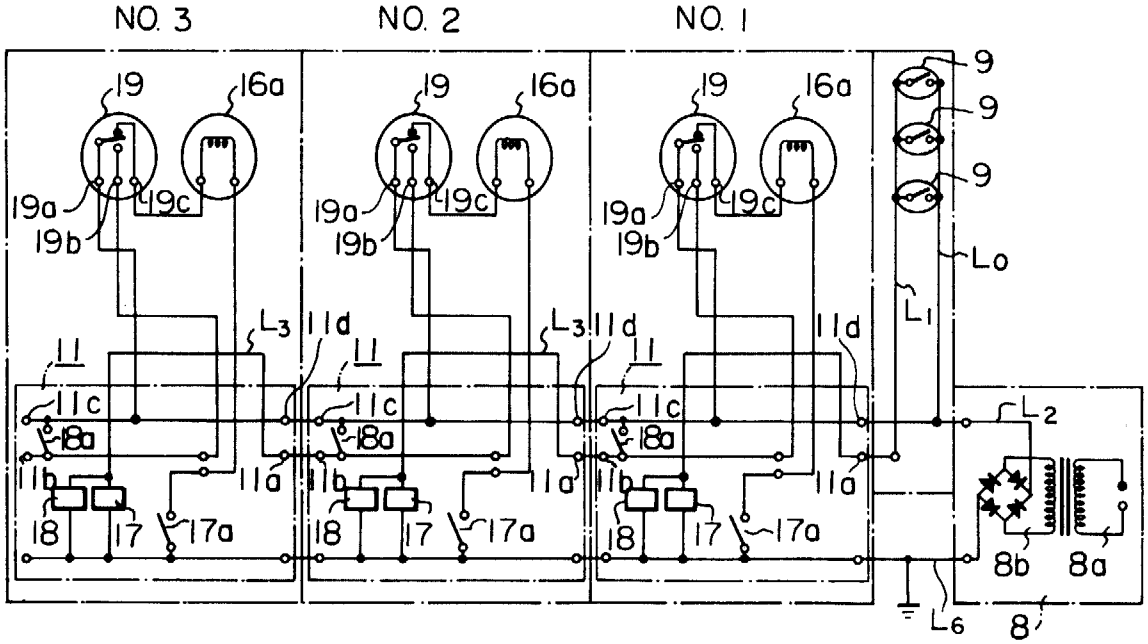
FIG. 3 is a diagram representing a series of control circuits applied to the automatic fire extinguishing system shown in FIG. 1.

The control circuit of the automatic fire-extinguishing system shown in FIG. 1 is hereinafter explained in detail with reference to the circuit diagram shown in FIG. 3. The control circuit of each fire-extinguisher is identical as shown in FIG. 3. Therefore this control circuit is hereinafter referred to as a unit control circuit. The unit control circuit comprises: a magnetic relay 17, provided with an on-off switch 17*a*; a timer relay 18, which is also a magnetic relay provided with an on-off switch 18*a*; an electic circuit 16*a* of a solenoid (not shown) of the electro-mechanical means for opening the valve 4, and; an electric circuit 19 of a limit switch (not shown) of the gas jet detecting switch 6. The unit control circuit is connected to an intermediate power source 8 comprising a transformer 8*a* and rectifier 8*b*. A terminal of the magnetic relay 17 and an terminal of the timer relay 18 are connected to a ground $L_6$ which is connected to one terminal of the rectifier 8*b*. The other terminal of the relays 17 and 18 are connected to an input terminal 11*a* of a control circuit 11 in parallel condition. One terminal of the on-off switch 17*a* is connected to the ground $L_6$, while the other terminal of the switch 17*a* is connected to an input terminal of the electric circuit 16*a* of the solenoid of the electro-mechanical means for opening the valve 4. The limit switch 19 is provided with three terminals 19*a*, 19*b* and 19*c* and the output terminal of the electric circuit 16*a* is connected to the terminal 19*c* of the limit switch 19. The terminal 19*a* is normally closed to the terminal 19*c* by the axial expansion of the bellows of the gas jet detecting switch 6 while the bomb 2 is filled with the compressed fire-extinguishing gas, but is capable of being connected to the terminal 19*b* when the bellows axially shrinks due to the gas jetting from the bomb 2. The terminal 19*a* is also normally connected to a power supply line $L_2$ which is connected the other terminal of the rectifier 8*b*. The terminal 19*b* is connected to an output terminal 11*b* of the control circuit 11. The line of this connection is hereinafter referred to as a line $L_3$. The line $L_2$ disposed in the control circuit 11 is provided with an input terminal 11*d* and an output terminal 11*c*, and the on-off switch 18*a* is utilized so as to be able to connect the line $L_2$ to the line $L_3$. This on-off switch 18*a* is actuated by the timer relay 18.

In the automatic fire-extinguishing system shown in FIG. 1, the fire sensors 9 are electrically connected in a series and, referring to FIG. 3 again, the input terminal thereof is connected to the line $L_2$ by way of a line $L_0$, while the output terminal thereof is connected to the input terminal 11*a* of the control circuit of the first fire-extnguisher No. 1. The unit control circuit of the fire-extinguisher No. 2 is connected to the unit control circuit of the fire-extinguisher No. 1 in such a way that the input terminal 11*a* of the fire-extinguisher No. 2 is connected to the output terminal 11*b* of the fire-extinguisher No. 1, while the input terminal 11*d* of the line $L_2$ of the fire-extinguisher No. 2 is connected to the output terminal 11*c* of the line $L_2$ of the fire-extinguisher No. 1. The connection of the unit control circuits of two adjacent fire-extinguishers are made in the same way as the above-mentioned connection of the unit control circuits of the fire-extinguishers No. 1 and No. 2. Therefore, in a case of utilizing a large number of fire-extinguishers for the automatic fire-extinguishing system according to the present invention, the assembled control circuit for controlling the functional operation of the fire-extinguishers can be made very simply.

The functional operation of the automatic fire-extinguishing system shown in FIGS. 1 and 3 will now be explained in detail. When anyone of the fire sensors 9 detects a fire, the line $L_0$ is connected to the line $L_1$ so that the sensing signal is input to the unit control circuit of the fire-extinguisher No. 1. Consequently, the magnet relay 17 is actuated to close the switch 17*a*. When the switch 17*a* is closed, the electric circuit 16*a* of the solenoid of the electro-mechanical means for opening the valve 4 is energized, so that the solenoid is actuated and inserts the needle 15 into the film 13*a* (FIGS. 2A, 2B). Accordingly, the film 13*a* is broken so that the gas contained in the space formed by the cylindrical space 4*a* and the space between the valve 4 and the cap 13 escapes therefrom, and the valve 4 is displaced toward the cap 13. When the valve 4 is displaced as mentioned above, the conduit 3 is connected to the conduit 2*a* so that the fire-extinguishing gas is ejected from the nozzle 7 of the fire-extinguisher No. 1. Consequently, the gas pressure in the bomb 2 is remarkably reduced so that bellows of the switch 6 is axially contracted. Accordingly, the connection between the terminals 19*a* and 19*c* of the limit switch 19 is opened and the terminal 19*b* is connected to the terminal 19*c* of the limit switch 19 of the fire-extinguisher No. 1. Therefore, electric power is transmitted to the line $L_3$ of the unit control circuit of the fire-extinguisher No. 2 via the output terminal 11*b* of the unit control circuit of the fire-extinguisher No. 1 and the input terminal 11*a* of the unit control circuit of the fire-extinguisher No. 2. Consequently, the fire-extinguisher No. 2 is actuated to eject the fire-extinguishing gas from the nozzle 7 thereof in the same manner as mentioned above. The fire-extinguishers No. 3, No. 4 and so on, are actuated so as to eject the fire-extinguishing gas from their own nozzles 7 one by one in succession, as mentioned above.

In the above-mentioned automatic fire-extinguishing system, if the relay 17 of the unit control circuit of some fire-extinguisher does not work, the fire-extinguishers arranged at electrically downstream positions can not work. For example, if the relay 17 of the fire-extinguisher No. 1 does not work, since it is impossible to energize the electric circuit 16*a* of the solenoid, the unit control circuit of the fire-extinguisher No. 2 can not receive the electrical actuation signal from the unit control circuit of the fire-extinguisher No. 1. Therefore, the remaining fire-extinguishers No. 2, No. 3, and so on, can not work. To prevent such a problem, the timer relay 18 is utilized in the unit control circuit of each fire-extinguisher. That is, when an actuation signal is transmitted to the timer relay 18, the timer relay 18 is actuated to close the on-off switch 18*a* after a predetermined time after the signal is transmitted thereto. Therefore, even if the magnet relay 17 does not close the on-off switch 17*a*, the unit control circuit of the fire-extinguisher No. 2 receives power from the line $L_2$ via the on-off switch 18*a* and the terminals 11*b* of the unit control circuit of the fire-extinguisher No. 1. Accordingly the fire-extinguishers, arranged at electrically downstream positions from the fire-extinguisher wherein the magnet relay 17 does not work, can be perfectly operated.

As mentioned above, the fire-extinguishers of the automatic fire-extinguishing system shown in FIG. 1 are actuated so as to eject the fire-extinguishing gas from their own nozzle 7 one by one successively, and;

the capacity of the intermediate power supply source can be reduced to a great extent from that required for the prior arts, for example reduced to only a capacity sufficient to work the sensors 9 and a single unit control circuit of a fire-extinguisher. As already pointed out, this is one of the advantages of the automatic fire-extinguishing system according to the present invention.

Figure 4A:
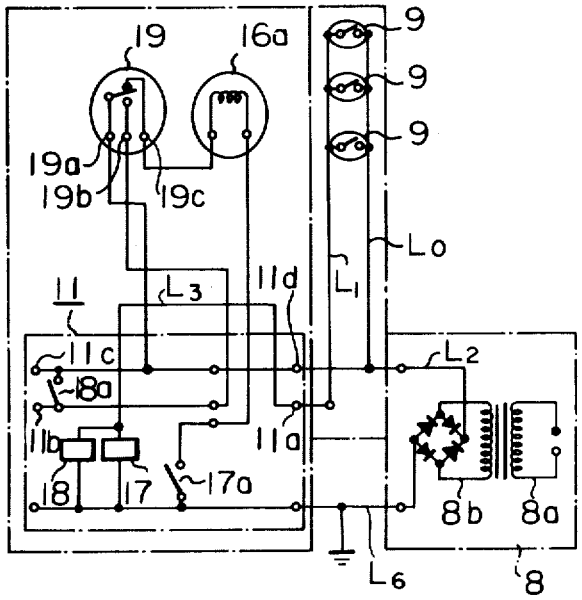
FIG. 4A is a diagram of the control circuit of an automatic fire extinguishing system utilizing a single fire extinguisher according to the present invention.

In the above-mentioned embodiment of the automatic fire-extinguishing system according to the present invention, several fire-extinguishers are utilized. However, it is also possible to use only a single fire-extinguisher which is utilized as component fire-extinguisher of the embodiment shown in FIG. 1. The control circuit of this embodiment is shown in FIG. 4A.

Figure 4B:
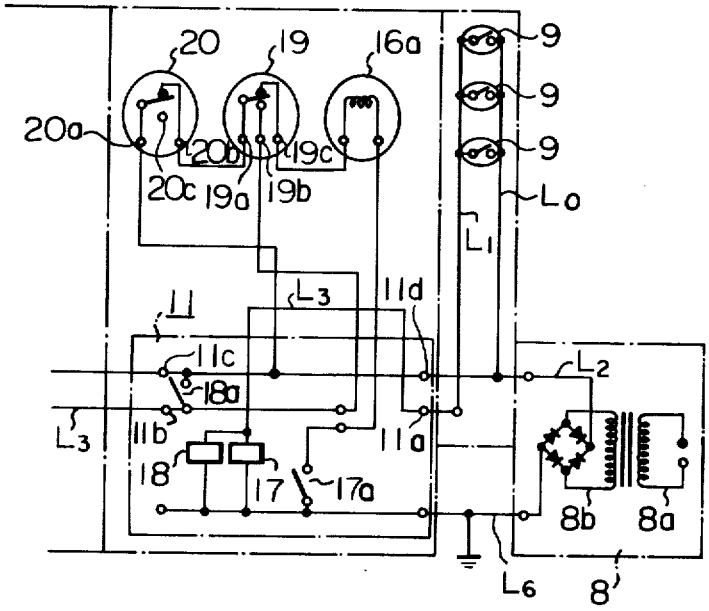
FIG. 4B is a diagram of a part of the control circuit of a modified embodiment of the automatic fire extinguishing system utilizing a plurality of fire-extinguishers according to the present invention.

According to our experience, there is a possibility of gas leakage afeter disposition of the fire-extinguishers in the region to be protected. If the fire-extinguishing gas leaks from the bomb 2 of any fire-extinguisher, since the gas pressure in the bomb 2 is remarkably lowered, the bellows of the gas jetting detecting switch 6 may be axially contracted so that the limit switch 19 works in the same way as when a fire signal is issued from the sensor 9. That is, the actuation power is transmitted from the line $L_2$, via the terminals 19*a*, 19*b* and 11*b* of the unit control circuit of the fire-extinguisher, wherein the gas leaked from the bomb 2, to the line $L_3$ of the unit control circuit of the fire-extinguisher arranged at electrically downstream position therefrom. Therefore, the latter fire-extinguisher is actuated so as to eject the fire-extinguishing gas from the nozzle 7 thereof. To prevent such possibility, a safety switch 5 (FIG. 1) is inserted into each unit control circuit of any fire-extinguisher. This safety switch 5 has a similar construction to the construction of the switch 6 as shown in FIG. 4B. That is, the safety switch comprises a limit switch 20 and a bellows (not shown) which is capable of axially expanding or contracting according to the gas pressure in the bomb. The limit switch 20 is provided with an output terminal 20*a*, an input terminal 20*b* and a safety terminal 20*c*. The terminal 20*a* is normally closed to the terminal 20*b* due to the axial expansion of the bellows. However, if the bellows is contracted due to gas leakage from the bomb 2, the terminal 20*a* is connected to the safety terminal 20*c*. This safety switch 5 is put into the unit control circuit of each fire-extinguisher as shown in FIG. 1. As it can be clearly understood from the disclosure of FIG. 4B, the output terminal 19*a* of the limit switch 19 is connected to the input terminal 20*b* of the limit switch 20, while the output terminal 20*a* is connected to the line $L_2$. Accordingly, even though the gas pressure in the bomb 2 is lowered by the gas leakage from the bomb 2, the unit control circuit of the fire-extinguisher, arranged at an electrically downstream position from the fire-extinguisher wherein the fire-extinguishing gas leaked from the bomb 2, does not receive any actuation signal. Consequently the above-mentioned possible trouble due to the gas leakage from the bomb 2 can be perfectly prevented.

What is claimed is:

1. An automatic fire-extinguishing system comprising: at least one automatic fire-extinguisher placed at a desired location within a region wherein automatic extinguishing should be effected when fire occurs therein, said at least one fire-extinguisher including integrally a bomb containing a fire-extinguishing gas under pressure and a gas jetting nozzle connected through a valve to said bomb; at least one fire sensor arranged at a desired location within said region; and an intermediate electric power supply source connected to said automatic fire-extinguishing system, said at least one fire extinguisher being provided with a relay to receive an actuation signal from outside and an electromechanical means for opening said valve, a gas jetting detecting switch for detecting gas pressure in said bomb and a unit control circuit for controlling the actuation of said fire-extinguisher, said unit control circuit comprising a series circuit provided with an electric actuation circuit of said opening means and an on-off switch, which is controlled by said relay in a condition of connecting in a series, a terminal of said series circuit connected to a terminal of said intermediate power supply source, a switch means of said gas jetting detecting switch for interrupting power supply to said series circuit in response to reduction of internal gas pressure in said bomb and for simultaneously out-putting an electric potential of the other terminal of said intermediate power supply source to an output terminal of said unit control circuit, said switch means connected to the other terminal of said series circuit and the other terminal of said intermediate power supply source, said relay of said at least one fire-extinguisher being capable of receiving a fire signal issued from said fire sensor.

2. An automatic fire-extinguishing system according to claim 1, further comprising a timer relay inserted into said unit control circuit of said at least one fire-extinguisher and an on-off switch connecting said other terminal of said intermediate power supply source and a connected line between an output terminal of said gas jetting detecting switch and said output terminal of said unit control circuit, said timer relay being capable of closing said on-off switch in response to an input actuation signal into said unit control circuit.

3. An automatic fire-extinguishing system according to claim 1, further comprising an auxiliary control circuit means for interrupting the transmission of an output signal from said gas jetting detecting switch to said output terminal of said unit control circuit of said at least one fire extinguisher, said auxiliary control circuit inserted into a connection circuit between said output terminal of said gas jetting detecting switch and said output terminal of said unit control circuit, said auxiliary control circuit being capable of connecting said output terminal of said gas jetting switch to said output terminal of said unit circuit only when the pressure of the internal gas contained in said bomb is maintained at a predetermined pressure level.

4. An automatic fire-extinguishing system according to claim 1, wherein said intermediate power supply source comprises a transformer and rectifier connected to said transformer.

5. An automatic fire-extinguishing system according to claim 1, wherein said intermediate power supply source is a D.C. Battery.

6. An automatic fire-extinguishing system according to claim 1, wherein said intermediate power supply source is mounted on any of said fire-extinguishers.

7. An automatic fire-extinguishing system as set forth in claim 1 wherein said at least one fire-extinguisher is at least two fire-extinguishers and wherein said relay of one of said fire-extinguishers is capable of receiving a fire signal issued from said sensor while said relay of the other fire extinguisher is capable of receiving an actuation signal from said output terminal of said unit control circuit of said fire-extinguisher at an electrically connected adjacent upstream position.

* * * * *